US009534535B2

(12) United States Patent
Takahashi et al.

(10) Patent No.: US 9,534,535 B2
(45) Date of Patent: Jan. 3, 2017

(54) FOUR-STROKE ENGINE

(71) Applicants: Yuji Takahashi, Aichi (JP); Yuki Nakamura, Shizuoka (JP); Masaki Kurimoto, Shizuoka (JP); Masayuki Iwase, Shizuoka (JP)

(72) Inventors: Yuji Takahashi, Aichi (JP); Yuki Nakamura, Shizuoka (JP); Masaki Kurimoto, Shizuoka (JP); Masayuki Iwase, Shizuoka (JP)

(73) Assignee: MAKITA CORPORATION, Aichi (JP)

( * ) Notice: Subject to any disclaimer, the term of this patent is extended or adjusted under 35 U.S.C. 154(b) by 215 days.

(21) Appl. No.: 13/668,570

(22) Filed: Nov. 5, 2012

(65) Prior Publication Data

US 2013/0139796 A1 Jun. 6, 2013

(30) Foreign Application Priority Data

Dec. 2, 2011 (JP) ..... 2011-264872

(51) Int. Cl.
*F02B 25/06* (2006.01)
*F02B 63/02* (2006.01)
*F02B 75/02* (2006.01)

(52) U.S. Cl.
CPC ..... *F02B 63/02* (2013.01); *F02B 2075/027* (2013.01)

(58) Field of Classification Search
CPC ..... F01M 13/04; F01M 13/022; F02B 63/00; F02B 63/02; F02B 2075/02; F02B 2075/027; B01D 45/04; B01D 45/08; B01D 46/0031; B01D 3/20; B01D 21/2444; B01D 29/336; B01D 29/92; B01D 2201/46; B01D 2313/12
(Continued)

(56) References Cited

U.S. PATENT DOCUMENTS 4,597,372 A * 7/1986 Furukawa ..... 123/572
6,223,713 B1 5/2001 Moorman et al.
(Continued)

FOREIGN PATENT DOCUMENTS

EP 1149997 10/2001
JP 63-134121 9/1988
(Continued)

OTHER PUBLICATIONS

Search report from E.P.O., mail date is Jul. 26, 2013.
(Continued)

*Primary Examiner* — Lindsay Low
*Assistant Examiner* — Omar Morales
(74) *Attorney, Agent, or Firm* — Greenblum & Bernstein, P.L.C.

(57) ABSTRACT

A four-stroke engine for a working machine with a rod is provided, where a tool is attached to one end of the rod in a longitudinal direction and the four-stroke engine is fixed to the other end of the rod in use. The four-stroke engine includes: an oil circulation pathway; and a gas-liquid separating chamber configured to separate oil from blowby gas. The gas-liquid separating chamber includes: an inflow part into which the blowby gas is introduced from the oil circulation pathway; oil discharge parts configured to flow the oil separated from the blowby gas back to the oil circulation pathway; and a blowby gas discharge part configured to discharge the blowby gas not containing oil mist from the gas-liquid separating chamber and supplies the blowby gas to an intake passageway to a combustion chamber.

14 Claims, 11 Drawing Sheets

(58) Field of Classification Search
USPC ..... 123/573, 572, 196 R, 196 M; 184/6.2, 184/11.1; 96/155, 181; 55/342, 421; 210/188
See application file for complete search history.

(56) References Cited

U.S. PATENT DOCUMENTS

| | | | | |
|---|---|---|---|---|
| 7,621,982 | B2 * | 11/2009 | Kang | B01D 53/261 210/321.64 |
| 2001/0015182 | A1 | 8/2001 | Moorman et al. | |
| 2001/0029910 | A1 | 10/2001 | Ito et al. | |
| 2002/0083934 | A1 | 7/2002 | Ruehlow et al. | |
| 2003/0079704 | A1 | 5/2003 | Ito et al. | |
| 2003/0079711 | A1 | 5/2003 | Ito et al. | |
| 2007/0006857 | A1 * | 1/2007 | Miyake et al. | 123/572 |
| 2010/0313843 | A1 * | 12/2010 | Marushima | F01M 3/02 123/196 M |
| 2011/0067659 | A1 * | 3/2011 | Sugiyama | F01M 1/04 123/90.33 |

FOREIGN PATENT DOCUMENTS

| | | |
|---|---|---|
| JP | 2000-257412 | 9/2000 |
| JP | 2002-349227 | 12/2002 |
| JP | 2007-224824 | 9/2007 |

OTHER PUBLICATIONS

Japanese Office Action mailed Apr. 24, 2015 in Japanese Patent Application No. 2011-264872 along with an English translation thereof.

* cited by examiner

A

B

A

B

FOUR-STROKE ENGINE

CROSS-REFERENCES TO RELATED APPLICATIONS

This application claims the benefit of Japanese Patent Application No. 2011-264872, filed on Dec. 2, 2011, the entire contents of which are incorporated herein by reference.

BACKGROUND

1. Technical Field

The present invention relates to a four-stroke engine used as a power source for a portable working machine such as a coffee harvester, an olive harvester or bush cutter, which has a tool at its one end.

2. Related Art

In recent years, there is an increased demand for a working machine equipped with a four-stroke engine. Previously, a four-stroke engine was used for only a brush cutter and a backpack working machine, but recently has been widely used for, for example, a pole saw, a pole hedge trimmer, and a coffee harvester. For example, a portable four-stroke engine has been known as disclosed in Japanese Patent Application Laid-Open No. 2007-224824. In general, the part around a crankshaft needs a greater amount of oil than for a valve operating mechanism. Then, conventionally, a lubrication apparatus supplies the oil or oil mist in a crank chamber to a valve operating chamber and a valve operating mechanism, using pressure fluctuation in the crank chamber, without controlling the amount of the oil or oil mist. Therefore, the oil or oil mist is oversupplied to the valve operating chamber to lubricate the valve operating mechanism. As a result, too much oil remains in the valve operating chamber. This causes a problem that when the engine is used in different positions, oil is discharged in large quantities while blowby gas is discharged to a combustion chamber, so that oil can be consumed fast. Then, oil consumption for a short period of time causes the period of time over which oil is refilled until the next time, to be shortened, and therefore if refilling of oil is neglected, lubrication trouble may occur. In addition, if an amount of oil to be discharged further increases, unburned oil is discharged from a muffler to the outside, and this may cause environmental damage. As described above, a portable four-stroke engine has been used for various purposes, and therefore has been used in different postures.

SUMMARY

The present invention was achieved in view of the above-described background, and therefore it is an object of the present invention to provide a four-stroke engine configured to reliably perform gas-liquid separation, that is, separate oil and oil mist from blowby gas, in order to prevent oil from being discharged to a combustion chamber.

To solve the above-described problem, according to a first aspect of the present invention, a four-stroke engine for a working machine with a rod is provided where a tool is attached to one end of the rod in a longitudinal direction and the four-stroke engine is fixed to the other end of the rod in use, the four-stroke engine includes: an oil circulation pathway; and a gas-liquid separating chamber configured to separate oil from blowby gas. The gas-liquid separating chamber includes: an inflow part into which the blowby gas is introduced from the oil circulation pathway; oil discharge parts configured to flow the oil separated from the blowby gas back to the oil circulation pathway; and a blowby gas discharge part configured to discharge the blowby gas not containing oil mist from the gas-liquid separating chamber and supplies the blowby gas to an intake passageway to a combustion chamber. The oil discharge parts are formed as openings on at least two corners in a lower part of the gas-liquid separating chamber in the longitudinal direction.

Preferably, the plurality of oil discharge parts are formed in the gas-liquid separating chamber at intervals in a direction in which each of the oil discharge parts is away from an axis line of the rod.

Preferably, the blowby gas discharge part is formed as an opening in a center of the gas-liquid separating chamber.

Preferably, the blowby gas discharge part is enclosed by a wall.

Preferably, the wall has an inverted U-shape which is open downward.

To solve the above-described problems, according to a sixth aspect of the present invention, a four-stroke engine includes a gas-liquid separating chamber configured to separate oil mist from blowby gas containing the oil mist, the gas-liquid separating chamber branching from an oil circulation pathway. The gas-liquid separating chamber includes: an inflow part into which the blowby gas is introduced from the oil circulation pathway; oil discharge parts configured to flow oil separated from the blowby gas back to the oil circulation pathway; and a blowby gas discharge part configured to discharge the blowby gas not containing the oil mist. The blowby discharge part is formed as an opening in a center of the gas-liquid separating chamber; and a wall is formed around the blowby gas discharge part.

Preferably, the wall has an inverted U-shape which is open downward.

Preferably, a gas-liquid separating member is disposed between the inflow part and the blowby gas discharge part.

Preferably, the gas-liquid separating member has a mesh structure.

With the present invention, it is possible to provide a four-stroke engine including a gas-liquid separator configured to reliably separate oil from blowby gas in order to prevent the oil from being discharged to the combustion chamber.

DESCRIPTION OF EXEMPLARY EMBODIMENTS

Now, a gas-liquid separator and a lubrication apparatus in a four-stroke engine according to the present invention will be described with reference to FIG. 1. The lubrication apparatus is designed to be mounted in a four-stroke engine, and therefore a four-stroke engine including this lubrication apparatus will be explained with reference to FIG. 1.

Figure 1:
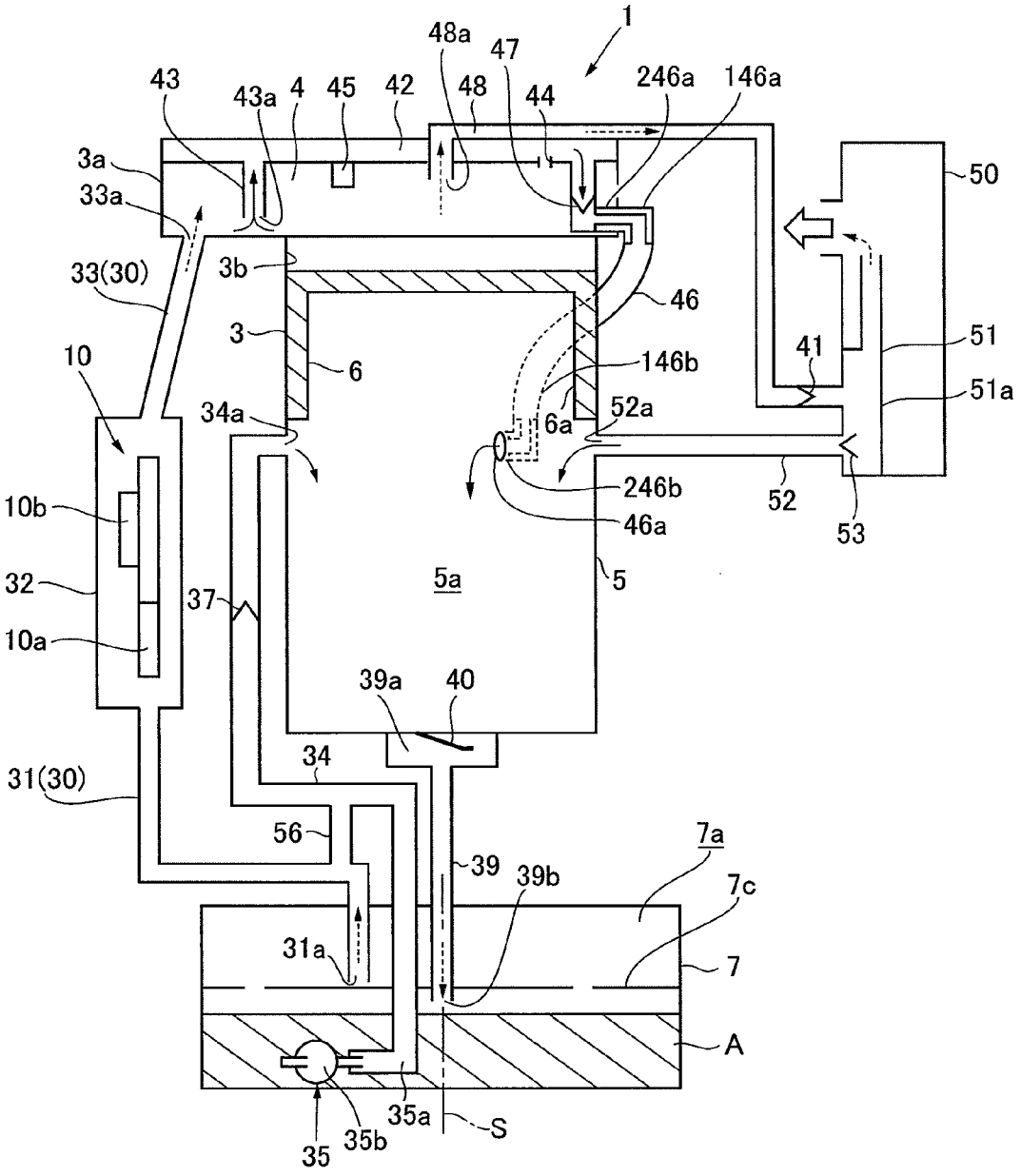
FIG. 1 shows a four-stroke engine in which a piston is located at the top dead center.

Here, FIG. 1 shows the four-stroke engine when a piston is located in the top dead center.

As shown in FIG. 1, a four-stroke engine 1 includes: a cylinder block 3 formed integrally with a cylinder head 3*a*; a crankcase 5 which is mounted to the lower part of the cylinder block 3 and constitutes a crank chamber 5*a*; and an oil reservoir 7 provided below the crankcase 5.

The oil reservoir 7 is provided separately from the crankcase 5 and accumulates lubricating oil (hereinafter referred to as "oil A").

A crankshaft (not shown) is rotatably supported in the connecting portion between the cylinder block 3 and the crankcase 5. A piston 6 is connected to the crankshaft via a counterweight and a connecting rod and so forth coupled with the counterweight. The piston 6 is slidably inserted in the cylinder 3*b* in the cylinder block 3.

An intake port and an exhaust port are provided on the upper wall of the cylinder 3*b* in the cylinder block 3. The intake port and the exhaust port communicate with a carburetor (not shown) and an exhaust muffler (not shown), respectively, and have an intake valve and an exhaust valve to open and close the respective ports.

Here, the four-stroke engine 1 according to the present embodiment may be carried by the user in use. In this case, the four-stroke engine 1 may tilt forward and backward, or left and right, or turn upside and down on a temporary basis in use.

A valve operating mechanism 10 drives the above-described valves and includes parts such as a valve driving gear 10*a* firmly fixed to the crankshaft, a cam gear 10*a* driven by the valve driving gear 10*a*, to which a cam is connected, and a rocker arm (not shown).

The valve driving gear 10*a* and the cam gear 10*b* of the valve operating mechanism 10 are accommodated in a valve driving chamber 32. This valve driving chamber 32 is provided on the way of a supply passageway 30 that allows communication between the valve operating chamber 4 formed in the head of the cylinder block 3 and the oil reservoir 7. Meanwhile, the other parts of the valve operating mechanism 10, such as the rocker arm and so forth, are provided in the valve operating chamber 4. Here, the supply passageway 30 is formed by a valve operating mechanism-supply passageway 31 and a push rod passageway 33.

An oil feeding passageway 34 is provided between the oil reservoir 7 and the cylinder block 3. An intake part 35 is mounted at the end of the oil feeding passageway 34 in the oil reservoir 7 side. The intake part 35 has a tubular body 35*a* which is made of an elastic material such as rubber and is easily flexible, and a weight 35*b* with an intake port mounted on the tip of the tubular body 35*a*. This weight 35*b* in the intake part 35 is mounted to be able to move downward in a vertical direction by gravity. Therefore, even if the oil reservoir 7 is tilted, it is possible to place the suction port of the intake part 35 below the level of the oil A accumulated within a prescribed amount.

The oil feeding passageway 34 serves to allow communication between the crank chamber 5*a* and the oil reservoir 7 to suck up the oil A from the oil reservoir 7 and supplies the oil A into the crank chamber 5*a* when the pressure in the crank chamber 5*a* tends to be a negative pressure because the piston 6 moves upward.

An opening 34*a* of the oil feeding passageway 34 which is open in the crank chamber 5 is positioned such that the opening 34*a* opens as the piston 6 moves from a position near the top dead center to the top dead center. In other words, the opening 34*a* is positioned to open when the skirt part 6*a* which is the lower part of the piston 6 passes over the opening 34*a*. Therefore, the opening 34*a* of the oil feeding passageway 34 has already been fully open at the time the piston 6 arrives at the top dead center. Here, when a negative pressure is created in the crank chamber 5*a*, the oil feeding passageway 34 and the crank chamber 5*a* may communicate with one another, by, for example, providing a reed valve in the opening 34*a* of the oil feeding passageway 34, or providing a passageway in the crankshaft to function as a rotary valve.

A check valve 37 is provided on the way of the oil feeding passageway 34. This check valve 37 is configured to open and close in response to pressure fluctuation in the crank chamber 5*a*. To be more specific, the check valve 37 opens when the pressure in the crank chamber 5*a* is lower than the pressure in the oil reservoir 7 to allow the oil feeding passageway 34 to communicate with the crank chamber 5*a*, and closes when the pressure in the crank chamber 5*a* is higher than in the oil reservoir 7.

A communicating passageway 56 allows communication between the valve operating mechanism-supply passageway 31 of the supply passageway 30 and the oil feeding passageway 34. By this means, when a negative pressure is created in the crank chamber 5*a*, part of the oil passing through the valve operating mechanism-supply passageway 31 of the supply passageway 30 is supplied to the oil feeding passageway 34 to prevent oil from being oversupplied to the supply passageway 30.

A communicating passageway 39 is provided between the bottom of the crank chamber 5*a* and the oil reservoir 7 to allow communication between the crank chamber 5*a* and the oil reservoir 7. This communicating passageway 39 serves to supply oil mist produced in the crank chamber 5*a* and oil resulting from liquefying the oil mist, to the oil reservoir 7.

A reed valve 40 is provided in an opening 39*a* of the communicating passageway 39, which is open in the crank chamber 5*a*. This reed valve 40 is configured to be able to open and close in response to pressure fluctuation in the crank chamber 5*a*. To be more specific, the reed valve 40 opens because a positive pressure is created in the crank chamber 5*a* when the piston 6 moves to the bottom dead center, and therefore allows the communicating passageway 39 to communicate with the crank chamber 5*a*.

Therefore, when the reed valve 40 opens to allow the communicating passageway 39 to communicate with the crank chamber 5*a*, the oil mist and the oil in the crank chamber 5*a* are supplied to the oil reservoir 7 through the communicating passageway 39.

A spacial part 7*b* in the oil reservoir 7 is separated by a baffle plate 7*c* that also functions as a gasket. An opening 31*a* of the valve operating mechanism-supply passageway 31 of the supply passageway 30 is formed above the baffle plate 7*c*. Here, the baffle plate 7*c* is not indispensable.

An opening 39*b* of the communicating passageway 39 in the oil reservoir 7 is open in approximately the center in the oil reservoir 7. This opening 39 is positioned above the level of the oil A accumulated in an amount equal to or smaller than a prescribed amount, regardless of how the oil reservoir 7 is tilted. Therefore, the oil mist discharged from the opening 39*b* of the communicating passageway 39 is returned gently into the oil A in the oil reservoir 7. By this means, it is possible to return the oil mist to the oil reservoir 7 gently without agitating the oil in the oil reservoir 7, and liquefy most of the oil mist. However, part of the oil mist discharged from the opening 39*b* rebounds from the surface of the oil A or the surface of the wall and remains in the special part 7*a* in the oil reservoir 7 above the level of the oil A. In this way, the opening 39*b* of the communicating passageway 39 placed above the level of the oil A functions as part of a liquefying means. Therefore, most of the oil mist discharged from the communicating passageway 39 is liquefied, and therefore it is possible to reduce the concentration of the oil mist accumulated in the oil reservoir 7.

The opening 31*a* of the valve operating mechanism-supply passageway 31 of the supply passageway 30 is open in approximately the center in the inner space of the oil reservoir 7. This opening 31*a* is arranged not to be positioned below the level of the oil A even if the oil reservoir 7 is tilted and the level of the oil A accumulated within a prescribed amount varies. Moreover, as shown in FIG. 1, the opening 39*b* of the communication passageway 39 extends more than the opening 31*a* of the valve operating mechanism-supply passageway 31 of the supply passageway 30.

In this way, the arrangement is adopted where the opening 39*b* of the communicating passageway 39 extends more than the opening 31*a* of the valve operating mechanism-supply passageway 31 of the supply passageway 30 into the oil reservoir 7. By this means, it is possible to prevent the oil mist discharged from the opening 39*b* of the communicating passageway 39 from directly entering the opening 31*a* of the valve operating mechanism-supply passageway 31 of the supply passageway 30. More preferably, another exemplary configuration is possible where the communicating passageway 39 and the valve operating mechanism-supply passageway 31 of the supply passageway 30 may be arranged such that the distance between the communicating passageway 39 and the valve operating mechanism-supply passageway 31 increases in the direction of the openings.

That is, the oil mist discharged from the communicating passageway 39 does not directly enter the opening 31*a* of the valve operating mechanism-supply passageway 31 of the supply passageway 30, as long as the opening 31*a* is placed in the base end side of the communicating passageway 39 with respect to the plane of the opening 39*b* orthogonal to the direction (indicated by a dashed line) in which the communicating passageway 39 extends.

That is, with the arrangement of the valve operating mechanism-supply passageway 31 of the supply passageway 30 and the communicating passageway 39 in the oil reservoir 7, it is possible to prevent the oil mist discharged from the communicating passageway 39 from flowing directly into the opening 31*a* of the valve operating mechanism-supply passageway 31 of the supply passageway 30. Therefore, the concentration of the oil mist flowing through the valve operating mechanism-supply passageway 31 of the supply passageway 30 is lower than that of the oil supplied from the oil feeding passageway 34 into the crank chamber 5*a*.

The opening 33*a* of the supply passageway 30 in the valve operating chamber 4 side opens in the valve operating chamber 4 in the cylinder block 3 side. Therefore, the oil mist flowing through the valve operating mechanism-supply passageway 31 of the supply passageway 30 lubricates the valve operating mechanism 10 in the valve driving chamber 32, is discharged from the opening 33*a* into the valve operating chamber 4, and lubricates the rocker arm and so forth in the valve operating chamber 4.

A push rod passageway 33 allows communication between the valve operating chamber 4 and the valve driving chamber 32. An opening 33*a* allows communication between the push rod passageway 33 and the valve operating chamber 4. The push rod penetrates the push rod passageway 33 to drive the rocker arm in the valve operating chamber 4.

In addition, a protruding wall member 45 is formed in the valve operating chamber 4 to separate oil mist, liquefied oil and so forth from the fluid (oil mist, liquefied oil and blowby gas) flowing from the push rod passageway 33 into the valve operating chamber 4.

A plurality of suction tubes 43 to suck the oil accumulated in the valve operating chamber 4 are provided in the valve operating chamber 4.

The opening 43*a* of each suction tube 43 is arranged in the position near the bottom surface of the valve operating chamber 4 in the crank chamber 5*a* side to suck up the oil from the bottom surface of the valve operating chamber 4 in the crank chamber 5*a* side. Then, the suction tubes 43 are arranged in the corners of the valve operating chamber 4 in order to suck the oil accumulated in the valve operating chamber 4 through any of the suction tubes 43 even if the four-stroke engine 1 is tilted while the valve operating chamber 4 is located in an upper position.

The opening 43*a* of each suction tube 43 opens in the valve operating chamber 4 in the cylinder block 3 side. Then, the suction tubes 43 are connected to a suction passageway 42. The suction passageway 42 is provided in the valve operating chamber 4 in the opposite side to the crank chamber 5*a*. The suction tubes 43 are provided in the valve operating chamber 4 to communicate with the suction passageway 42 and extend to the crank chamber 5*a* side. Both ends of each suction tube 43 are open.

In addition, a plurality of small holes 44 are provided on the suction passageway 42. Therefore, it is possible to suck the oil accumulated in the valve operating chamber 4 through any of the small holes 44 even if the four-stroke engine 1 is tilted to place the valve operating chamber 4 in a lower position.

A direct passageway 46 is provided in the suction passageway 42 to allow communication between the valve operating chamber 4 and the crank chamber 5*a* when a negative pressure is created in the crank chamber 5*a*.

An opening 246*b* of the direct passageway 46 is open in the crank chamber 5*a*. Like the opening 34*a* of the oil feeding passageway 34, this opening 246*b* is positioned such that the opening 246*b* opens as the piston 6 moves from a position near the top dead center to the top dead center. In other words, the opening 246*b* is positioned to open when the skirt part 6*a* which is the lower part of the piston 6 passes over the opening 246*b*.

There are the opening 246*b* of the direct passageway 46 and an opening 52*a* of an reflux passageway 52 in the crank chamber 5*a*. The reflux passageway 52 is configured to flow the oil separated in the air cleaner 50 back to the crank chamber 5*a*. These openings 246*b* and 52*a* are formed on a plane perpendicular to the direction in which the piston 6 slides. By this configuration, it is possible to use the oil from the valve operating chamber 4 which is recovered through the direct passageway 46 to lubricate the piston 6, as well as the oil from the air cleaner 50. In addition, it is possible to recover the oil from the air cleaner 50 and the oil from the valve operating chamber 4 which is recovered through the direct passageway 46, into the crank chamber 5*a* at the same time, and consequently achieve efficient recovery of oil. Therefore, the opening 246*b* of the direct passageway 46 has been fully open at the time the piston 6 arrives at the top dead center.

In addition, a check valve may be provided in the direct passageway 46 which allows oil to flow from the valve operating chamber 4 to the crank chamber 5*a* side and restricts oil from flowing from the crank chamber 5*a* to the valve operating chamber 4 side. In this way, it is possible to reliably prevent oil or oil mist from flowing backward from the crank chamber 5*a* to the valve operating chamber 4.

One end 48*a* of a breather passageway 48 is open in approximately the central part of the valve operating chamber 4, and the other end of the breather passageway 48 is connected to an air cleaner 50.

The breather passageway 48 is designed to discharge blowby gas to the combustion chamber. The oil mist and the blowby gas in the valve operating chamber 4 are delivered to the air cleaner 50 via the breather passageway 48 and separated into gas and liquid, that is, separated into blowby gas and oil by an mesh mechanism 51*a* of a gas-liquid separator 51 provided in the air cleaner 50.

The one end 48*a* of the breather passageway 48 is open in approximately the central part of the valve operating chamber 4, and therefore even if much oil remains in the valve operating chamber 4, does not easily suck the oil. A check valve 41 is provided in the breather passageway 48 to prevent blowby gas and oil mist from flowing backward from the air cleaner 50 to the valve operating chamber 4 side.

The oil having been subjected to the gas-liquid separation is supplied to the crank chamber 5*a* through a reflux passageway 52 that allows communication between the air cleaner 50 and the crank chamber 5*a*. A check valve 53 is provided in the reflux passageway 52 to allow oil to flow only to the crank chamber 5*a* side. Meanwhile, the blowby gas having been subjected to the gas-liquid separation is supplied to the combustion chamber.

That is, the oil circulation pathway of the lubrication apparatus is formed by the communicating passageway 39, the supply passageway 30 (including valve operating mechanism-supply passageway 31 and the push rod passageway 33), the suction tubes 43, the small holes 44, the suction passageway 42, the direct passageway 46, the breather passageway 48, and the reflux passageway 52.

When the four-stroke engine 1 is activated, the pressure in the crank chamber 5*a* changes due to the upward and downward motion of the piston 6. To be more specific, when the piston 6 moves upward, the pressure in the crank chamber 5*a* decreases and tends to be a negative pressure, and, on the other hand, when the piston 6 moves downward, the pressure in the crank chamber 5*a* increases and tends to be a positive pressure. As the piston 6 moves to the vicinity of the top dead center because the pressure in the crank chamber 5*a* tends to be a negative pressure, the opening 34*a* of the oil feeding passageway 34 starts opening to allow communication between the crank chamber 5*a* and the oil reservoir 7. As a result of this, the negative pressure in the crank chamber 5*a* affects the oil feeding passageway 34.

Even if the four-stroke engine 1 is tilted, the intake part 35 of the oil feeding passageway 34 is positioned below the level of the oil A in the oil reservoir 7, so that the oil A is sucked from the oil reservoir 7 and supplied into the crank chamber 5*a*. At the time the piston 6 arrives at the top dead center, the opening 34*a* has been fully open, and therefore it is possible to allow the negative pressure in the crank chamber 5*a* to substantially affect the oil feeding passageway 34. As a result, it is possible to sufficiently supply the oil A pumped up below the level of the oil A into the crank chamber 5*a*.

The oil supplied into the crank chamber 5*a* lubricates driving parts such as the piston 6 and the crankshaft. At the same time, the oil is scattered from these driving parts and becomes oil mist. Part of the oil mist adheres to the wall surface of the crank chamber 5*a* and is liquefied again.

When the piston 6 moves downward from the top dead center, the pressure in the crank chamber 5*a* changes to a positive pressure. Therefore, the reed valve 40 opens to allow communication between the crank chamber 5*a* and the oil reservoir 7. Then, the oil mist and the oil in the crank chamber 5*a* with a positive pressure are supplied to the oil reservoir 7 via the communicating passageway 39, so that the pressure in the oil reservoir 7 increases. The oil mist discharged from the communicating passageway 39 collides against the surface of the oil A accumulated in the oil reservoir 7 and the wall surface of the oil reservoir 7, and therefore is liquefied and stored in the oil reservoir 7.

The concentration of the oil mist remaining in the oil reservoir 7, which hit against and rebounded from in the oil reservoir 7, is lower than in the crank chamber 5*a*. Here, when a positive pressure is created in the crank chamber 5*a*, the oil feeding passageway 34 is blocked so as not to prevent the oil from flowing backward from the crank chamber 5*a* to the oil reservoir 7 due to the action of the check valve 37. Then, the opening 34*a* is closed by the piston 6.

An increase in the pressure in the oil reservoir 7 causes the pressure gradient between the oil reservoir 7 and the valve operating chamber 4, so that the oil mist accumulated in the oil reservoir 7 is supplied to the valve operating chamber 4 via the valve operating mechanism-supply passageway 31 of the supply passageway 30. In the course of supplying oil mist from the oil reservoir 7 to the valve operating chamber 4, each part of the valve operating mechanism 10 in the valve driving chamber 32 provided in the supply passageway 30 is lubricated. During this period of time, part of the oil mist is liquefied.

The oil mist supplied to the valve operating chamber 4 lubricates the valve operating mechanism 10 provided in the valve operating chamber 4 and is supplied to the crank chamber 5*a* via the direct passageway 46. Otherwise, in a case of the oil mist supplied into the vale operating chamber 4 is liquefied and remains in the vale operating chamber 4, it is possible to supply the oil into the crank chamber 5*a* due to the effect that the level of negative pressure in the crank chamber 5*a* is high. As a result of this, it is possible to prevent oil from remaining in the valve operating chamber 4. Therefore, it is possible to prevent oil from flowing out when blowby gas is discharged from the valve operating chamber 4 via the breather passageway 48.

Figure 2:
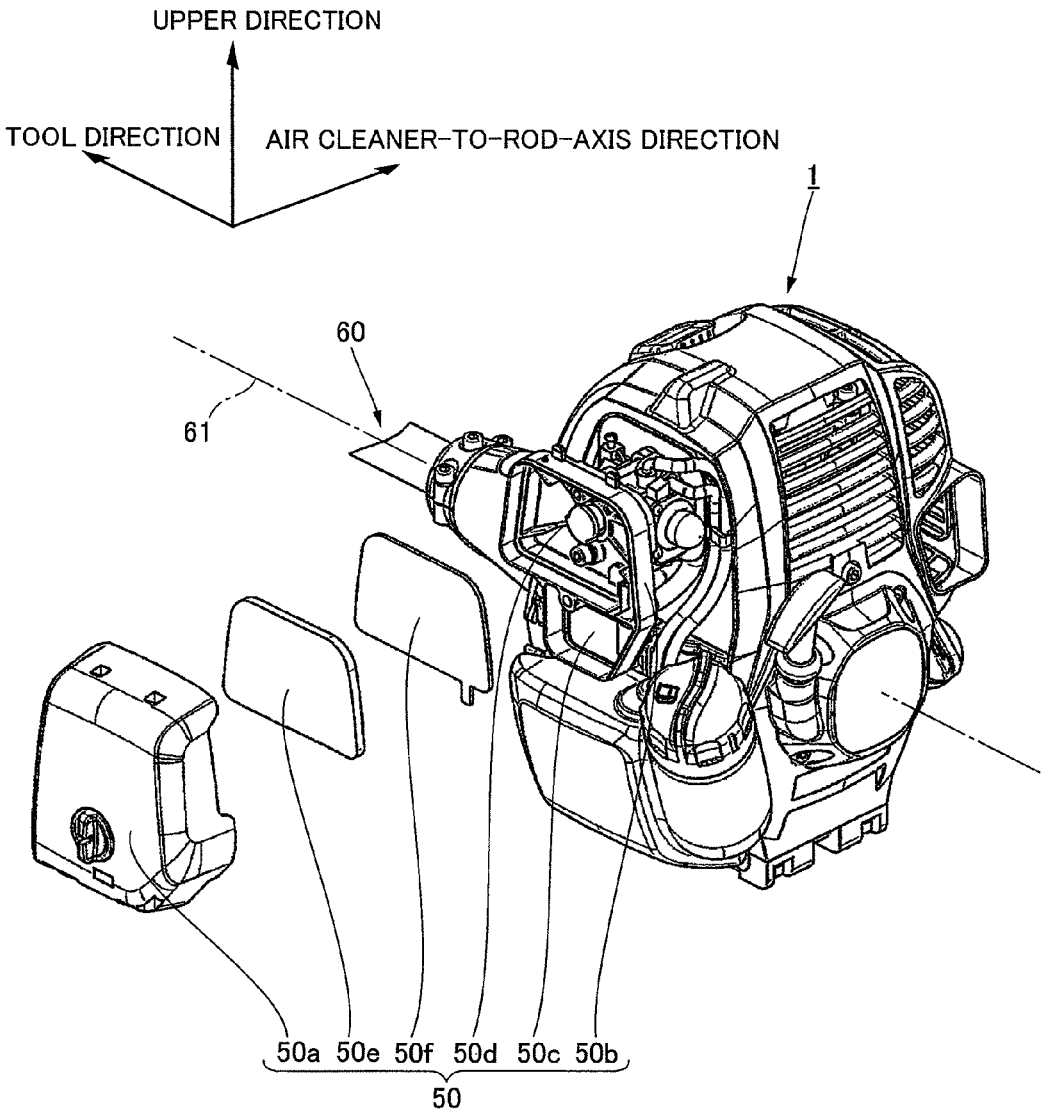
FIG. 2 is a drawing explaining an air cleaner.

FIG. 2 is a drawing explaining the air cleaner 50.

Here, the directions of the four-stroke engine 1 will be defined. In the present embodiment, "upper direction" means the upper side of the upstanding four-stroke engine 1 which is not used and, for example, stored (the upper side in FIG. 2). This upper direction substantially corresponds to the direction in which the four-stroke engine 1 stands upright for most of the period of time in use. The direction opposite to the upper direction is referred to as "lower direction" (the lower side in FIG. 2). The direction in which different tools driven by the four-stroke engine 1 are attached to one end of the rod 60 in the longitudinal direction, is defined as "tool direction" (the upper left in FIG. 2). The direction opposite to the tool direction is referred to as "anti-tool direction" (the lower right in FIG. 2). In addition, the direction of an axis line 61 of the rod 60 viewed from the air cleaner 50 mounted to the four-stroke engine 1 is referred to as "air cleaner-to-rod axis direction" (the upper right in FIG. 2). Moreover, the direction opposite to the air cleaner-to-rod axis direction is referred to as "anti-air cleaner-to-rod axis direction" (the lower left in FIG. 2.

As shown in FIG. 2, the rod 60 is connected to the four-stroke engine 1 in the tool direction. The tool is driven by the four-stroke engine 1 and attached to the front end of the rod 60. This four-stroke engine 1 is used in a blush cutter (see FIG. 9A) or an olive harvester (see FIG. 10A). Then, when the four-stroke engine 1 is used in a blush cutter, the four-stroke engine 1 is often tilted such that the rod 60 approaches the ground with increasing the distance from the four-stroke engine 1 (see FIG. 9A). Meanwhile, when the four-stroke engine 1 is used in an olive harvester, the four-stroke engine 1 is often tilted such that the rod 60 is away from the ground with increasing the distance from the four-stroke engine 1 (see FIG. 10A). Moreover, the four-stroke engine 1 is designed taking into account that the four-stroke engine 1 is turned upside and down temporarily in use (see FIG. 11A). Here, different tools are attached to the rod depending on the intended use.

The air cleaner 50 is located on the upper left of the four-stroke engine 1 provided that the rod 60 side is the forward direction. The air cleaner 50 has a function to absorb the air, filter dirt and dust contained in the air, and supply the cleaned air to the intake system. Particularly, with the present invention, the air cleaner 50 has a function to supply blowby gas to the intake system.

As shown in FIG. 2, the housing of the air cleaner 50 is formed by a removable air cleaner cover 50*a* and an air cleaner plate 50*b* fixed to the four-stroke engine in the anti-air cleaner-to-rod axis side.

The inside space defined by the air cleaner cover 50*a* and the air cleaner plate 50*b* includes a gas-liquid separating space 50*c* and an air cleaner space 50*d* for removing dirt and dust in the air.

A first air cleaner filter 50*e* and a second air cleaner filter 50*f* are provided in the air cleaner space 50*d* to remove dirt and dust in the air with a filter function.

The distance between the second air cleaner filter 50*f* and the air cleaner plate 50*b* is shorter than the distance between the first air cleaner filter 50*e* and the air cleaner plate 50*b*. The first air cleaner filter 50*e* is made of sponge and so forth meanwhile the second air cleaner filter 50*f* is made of felt.

Figure 3:
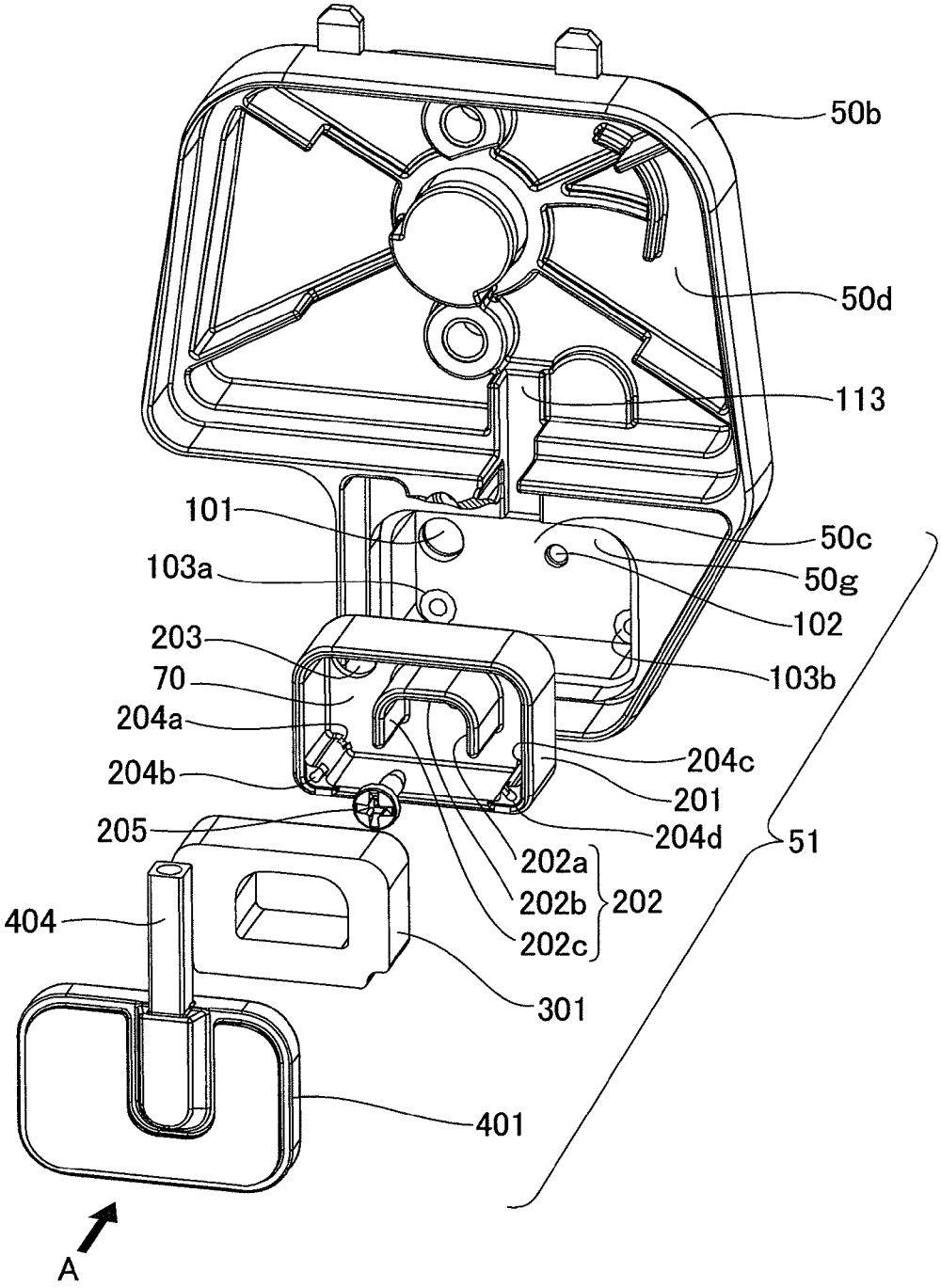
FIG. 3 is a drawing explaining a gas-liquid separator.
Figure 4:
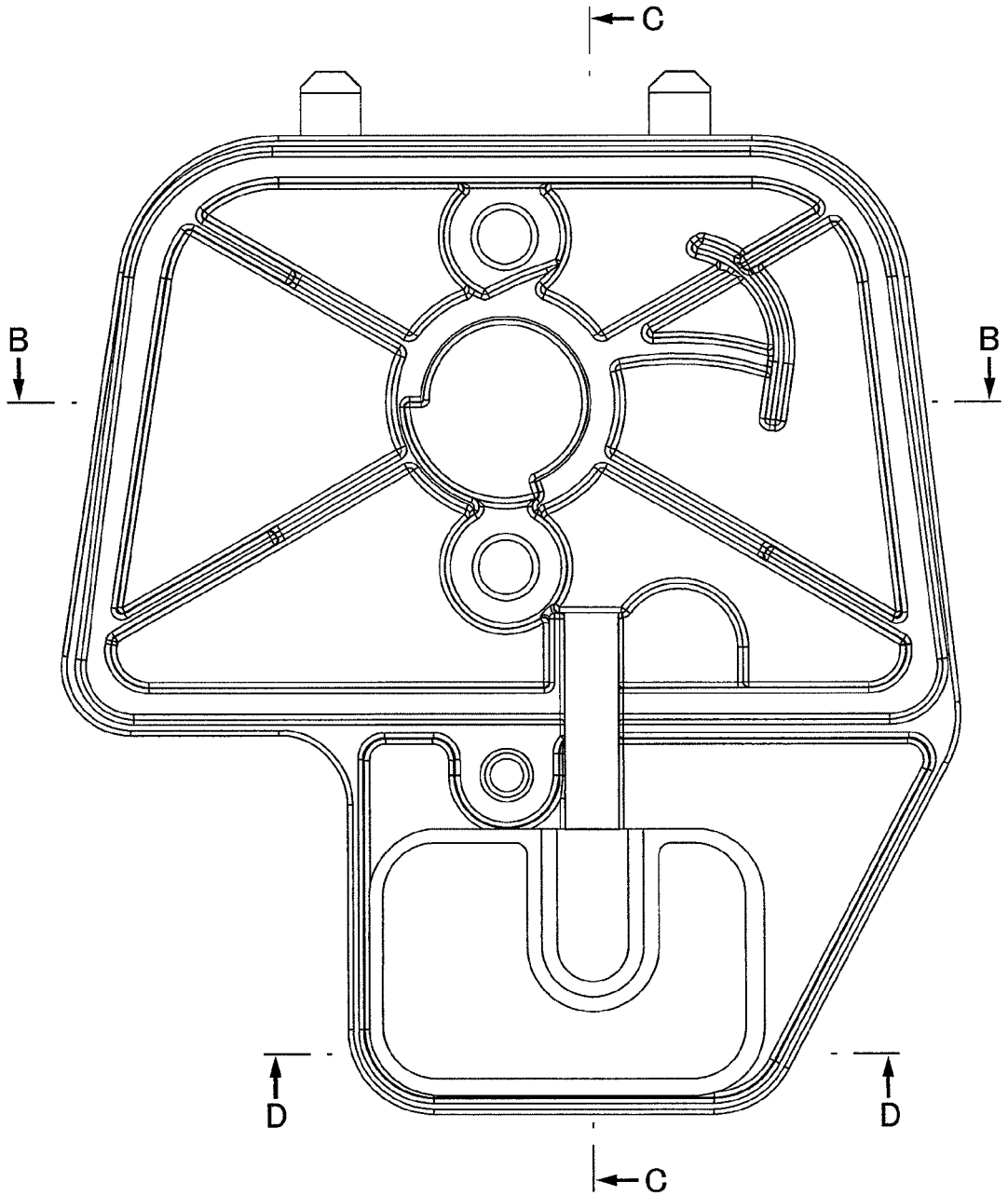
FIG. 4 is a drawing explaining a state in which a separator case, a gas-liquid separating plate and a gas-liquid separating member are set in a gas-liquid separating space in the air cleaner.
Figure 5:
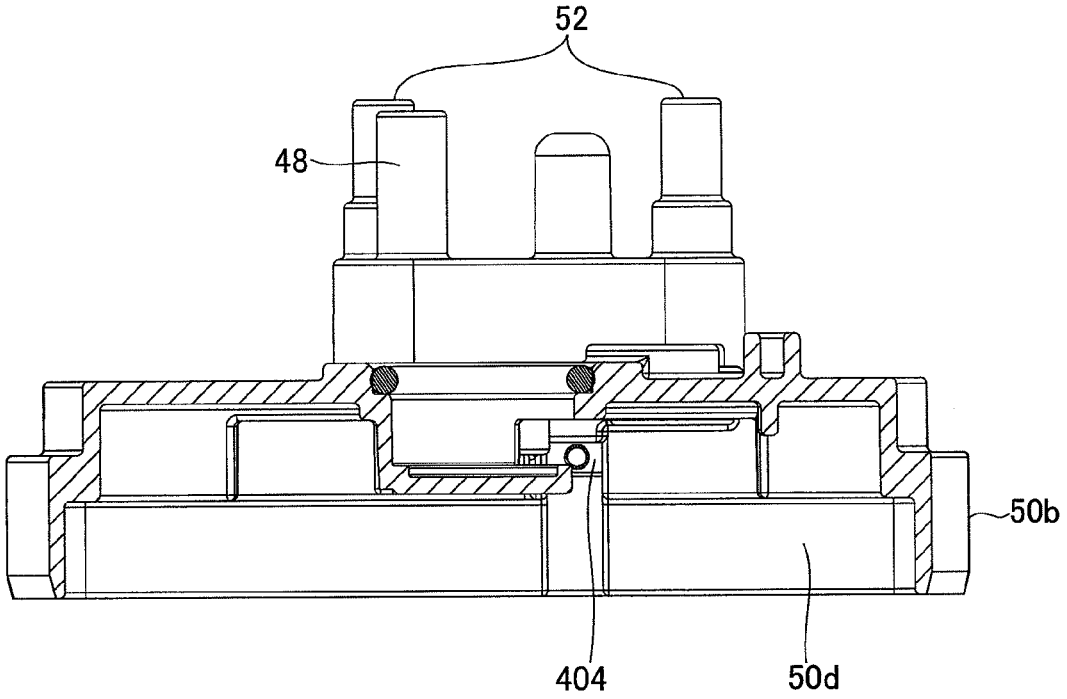
FIG. 5 is a cross-sectional view of FIG. 4 taken along line B-B.
Figure 6:
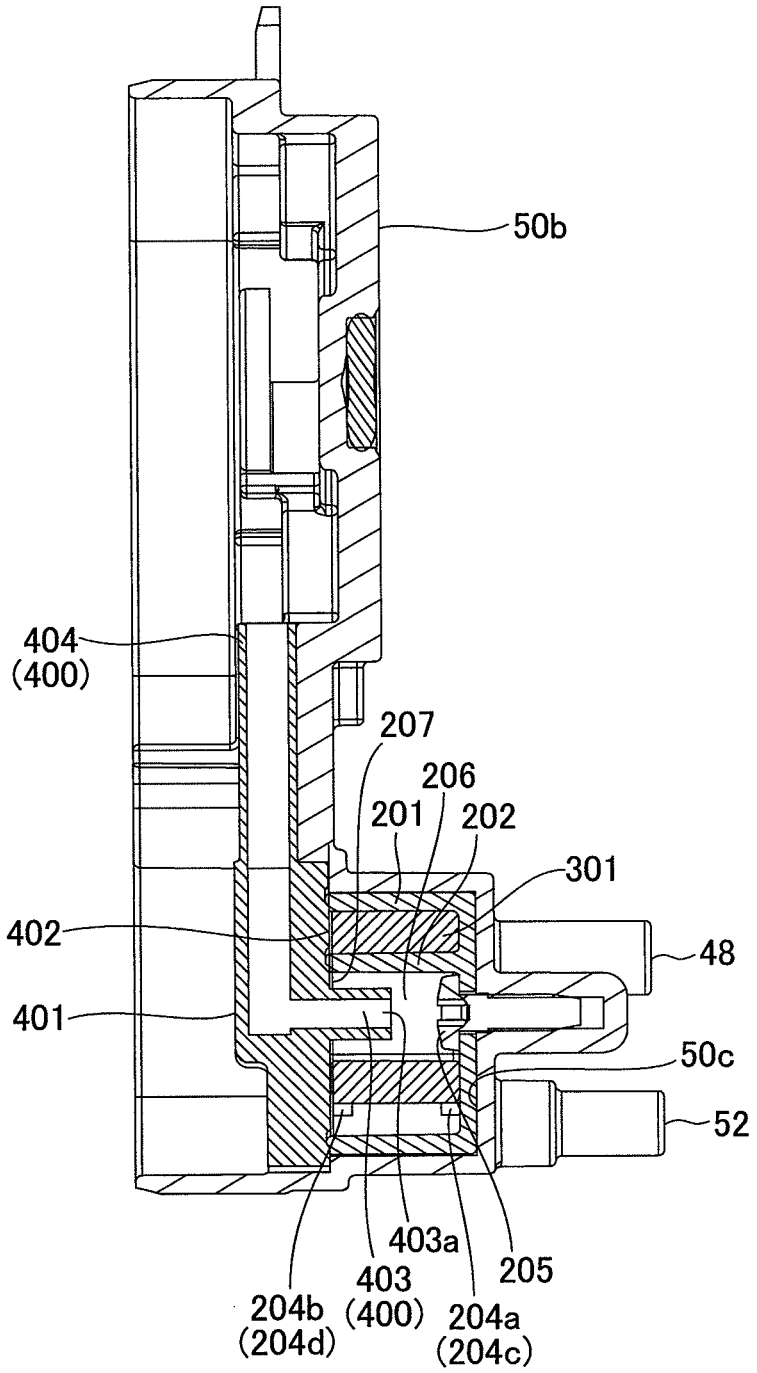
FIG. 6 is a cross-sectional view of FIG. 4 taken along line C-C.

FIG. 3 is a drawing explaining the gas-liquid separator 51. FIG. 4 is a drawing explaining a state in which the separator case 201, the gas-liquid separating plate 401 and the gas-liquid separating member 301 are set in the gas-liquid separating space 50*c* of the air cleaner 50. FIG. 5 is a cross-sectional view of FIG. 4 taken along line B-B. FIG. 6 is a cross-sectional view of FIG. 4 taken along line C-C. Now, the structure of the gas-liquid separator 51 will be explained with reference to FIGS. 3 to 6.

As shown in FIGS. 3 and 6, the gas-liquid separator 51 has the gas-liquid separating space 50*c* in which the separator case 201, the gas-liquid separating plate 401 and the gas-liquid separating member 301 are set.

Here, a second passageway 404 of the blowby gas discharging part 400 in the gas-liquid separating plate 401 is disposed in an air cleaner connection path 113 to span between the gas-liquid separating space 50*c* and the air cleaner space 50*d*. The air cleaner connection path 113 is configured to connect between the gas-liquid separating space 50*c* and the air cleaner space 50*d*. The air cleaner connection path 113 is formed at approximately the middle of the gas-liquid separating space 50*c*. The separator case 201, the gas-liquid separating member 301 and the gas-liquid separating plate 401 are arranged in the gas-liquid separating space 50*c* in this order in the anti-air cleaner-to-rod axis direction.

Here, the gas-liquid separating member 301 is provided in the separator case 201. A gas-liquid separating chamber 70 is formed in the separator case 201 as a space. This gas-liquid separating chamber 50 separates oil mist from blowby gas.

An inner side wall 50*g* is formed in the gas-liquid separating space 50*c* in the air cleaner-to-rod axis direction. An inflow port 101 is formed in the upper part of this inner side wall 50*g* in the tool direction and communicates with the breather passageway 48 (see also FIG. 1). Fluid containing blowby gas and oil mist flows from the inflow port 101 into the gas-liquid separating space 50*c*.

Oil discharge ports 103*a* and 103*b* are formed in the lower part of the inner side wall 50*g* of the gas-liquid separating space 50*c* in the air cleaner-to-rod axis direction. These oil discharge ports 103*a* and 103*b* communicate with the reflux passageway 52 configured to flow the oil separated by the gas-liquid separator 51 back to the crank chamber 5*a*. In other words, the oil discharge port 103*a* and the oil discharge port 103*b* are formed on the two corners of the lower part of the inner side wall 50*g*. In addition, as shown in FIG. 3, a screw hole 102 to fix the separator case 201 is formed in the inner side wall 50*g*. Then, the air cleaner plate 51*b* is fixed to the separator case 201 using a tapping screw 205. As a result, the inner side wall 50*g* is adhered tightly to the separator case 201. In this way, the inner side wall 50*g* and the separator case 201 are adhered tightly to one another, and therefore it is possible to prevent the fluid containing blowby gas and oil mist from the inflow port 101 from being discharged directly from the oil discharge port 103*a* or the oil discharge port 103*b*, without passing through the gas-liquid separating chamber 70.

An inflow part 203 configured to communicate with the inflow port 101 is formed in the separator case 201. Then, the oil discharge port 103*a*, and a plurality of oil discharge parts 204 (204*a*, 204*b*, 204*c* and 204*d*) are formed in the lower part of the gas-liquid separating chamber 70. The oil discharge port 103*a* is configured to communicate with the reflux passageway 52, and the oil discharge parts 204 are configured to communicate with the oil discharge port 103*b*. These oil discharge parts 204 discharge oil. The oil is obtained by liquefying oil mist separated from fluid containing blowby gas and the oil mist in the gas-liquid separating chamber 70.

An inverted U-shaped wall 202 is formed around a blowby gas discharge part 400 in the separator case 210. This inverted U-shaped wall 202 is formed integrally with the separator case 201. To be more specific, the wall 202 is formed by a wall portion 202*a* having the normal in the anti-tool direction, a wall portion 202*b* having the normal in the upper direction, and a wall portion 202*c* having the normal in the tool direction.

The gas-liquid separating plate 401 has a wall part 402 and the blowby gas discharge part 400. The blowby gas discharge part 400 includes an opening 403*a*, a first passageway 403 and a second passageway 404) (see FIGS. 5 and 6). Blowby gas containing oil mist, which flows from the inflow part 203 in the separator case 201 configured to communicate with the inflow port 101, collides with the wall part 402. The first passageway 403 discharges the blowby in a space 206 enclosed by the inverted U-shaped wall 202 in the separator case 201. The blowby gas flowing through the second passageway 404 is discharged to the air cleaner connection path 113 in the air cleaner space 50*d*.

The gas-liquid separating member 301 provided in the gas-liquid separating chamber 70 has a mesh structure that allows oil mist with small oil droplets contained in blowby gas to adhere to the mesh using oil viscosity and to be liquefied, and therefore to separate the oil mist from blowby gas.

Among the oil mist supplied to the valve operating chamber 4, the oil liquefied in the valve operating chamber 4 is returned to the crank chamber 5*a* through the direct passageway 46. Meanwhile, the oil mist contained in the blowby gas existing in the breather passageway 48 is introduced into the gas-liquid separating chamber 70 in the air cleaner 50 (see also FIG. 1). Then, the oil mist from the inflow part 203 of the separator case 201 collides with the gas-liquid separating plate 401. Here, the oil adhering to the wall surface is liquefied due to its viscosity, is separated from the blowby gas, and then falls down the wall surface. Moreover, the liquefied oil flows from the plurality of oil discharge parts 204*a*, 204*b*, 204*c* and 204*d* which are open in the lower part of the separator case 201, back to the crank chamber 5*a* through the oil discharge ports 103*a* and 103*b* configured to communicate with the reflux passageway 52.

Here, means for liquefying oil mist is not limited to the adhesion by using the wall part 402 of the gas-liquid separating plate 401. To be more specific, the mesh structure of the gas-liquid separating member 301 may be provided in the gas-liquid separating chamber 70. This mesh structure liquefies oil mist with small oil droplets to adhere to the mesh. Then, the liquefied oil passes through the mesh and flows from the plurality of oil discharge parts 204*a*, 204*b*, 204*c* and 204*d* which are open in the lower part of the separator case 201, back to the crank chamber 5*a*, through the oil discharge ports 103*a* and 103*b* configured to communicate with the reflux passageway 52.

The inverted U-shaped wall 202 provided in the separator case 201 functions as a baffle plate that prevents the inflow part 203 of the separator case 201 configured to communicate with the inflow port 101, from communicating with the opening 403*a* of the first passageway 403 from which blowby gas is discharged, by the most direct way. Also, as shown in FIG. 11B, the inverted U-shaped wall 202 functions as a baffle plate that prevents the liquefied oil from flowing into the opening 403*a* of the first passageway 403 from which blowby gas is discharged, even if the four-stroke engine 1 turns upside and down.

As shown in FIG. 6, the opening 403*a* of the first passageway 403 protrudes into a space 206 enclosed by the inverted U-shaped wall 202 provided in the separator case 201. By this means, it is possible to prevent the liquefied oil from entering the first passageway 403 of the blowby gas discharge part 400, from the wall 202 of the space 206. In addition, the opening 403*a* of the first passageway 403 is formed in the vicinity of the center of the gas-liquid separating chamber 70. To be more specific, the opening 403*a* is open at approximately the middle of the width of the gas-liquid separating chamber 70 in the air cleaner-to-rod axis direction. By this means, fluid containing oil mist and blowby gas cannot reach the opening 403*a* unless the fluid flows past the wall 202 and turns back, so that it is possible to separate oil mist from the fluid. Also, it is possible to prevent the liquefied oil mist from falling down a wall surface and so forth to reach the opening 403*a*.

Figure 7:
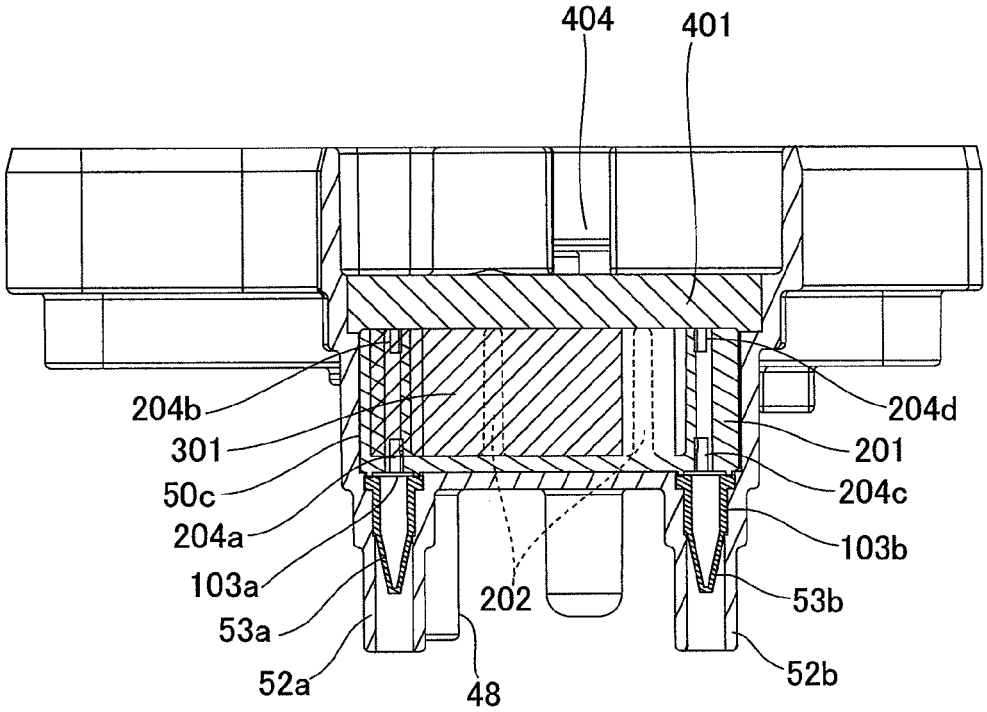
FIG. 7 is a cross-sectional view of FIG. 4 taken along line D-D.

FIG. 7 is a cross-sectional view of FIG. 4 taken along line D-D.

As shown in FIG. 7, the reflux passageway 52 has a reflux passageway 52*a* provided in the tool direction and a reflux passageway 52*b* provided in the anti-tool direction. These reflux passageway 52*a* and reflux passageway 52*b* merge and then communicate with the crank chamber 5*a* (see FIG. 1).

A check valve 53*a* to prevent oil from flowing backward is provided in the oil discharge port 103*a* which allows the reflux passageway 52*a* to communicate with the gas-liquid separating space 50*c*. This check valve 53*a* prevents oil from flowing backward, from the reflux passageway 52*a* to the gas-liquid separating space 50*c*. The oil discharge parts 204*a* and 204*b* communicate with the oil discharge port 103*a*. The oil discharge part 204*a* is disposed in the air cleaner-to-rod axis direction meanwhile the oil discharge part 204*b* is disposed in the anti-air cleaner-to-rod axis direction. Here, in FIG. 7, the wall 202 is shown in dashed line.

Figure 8:
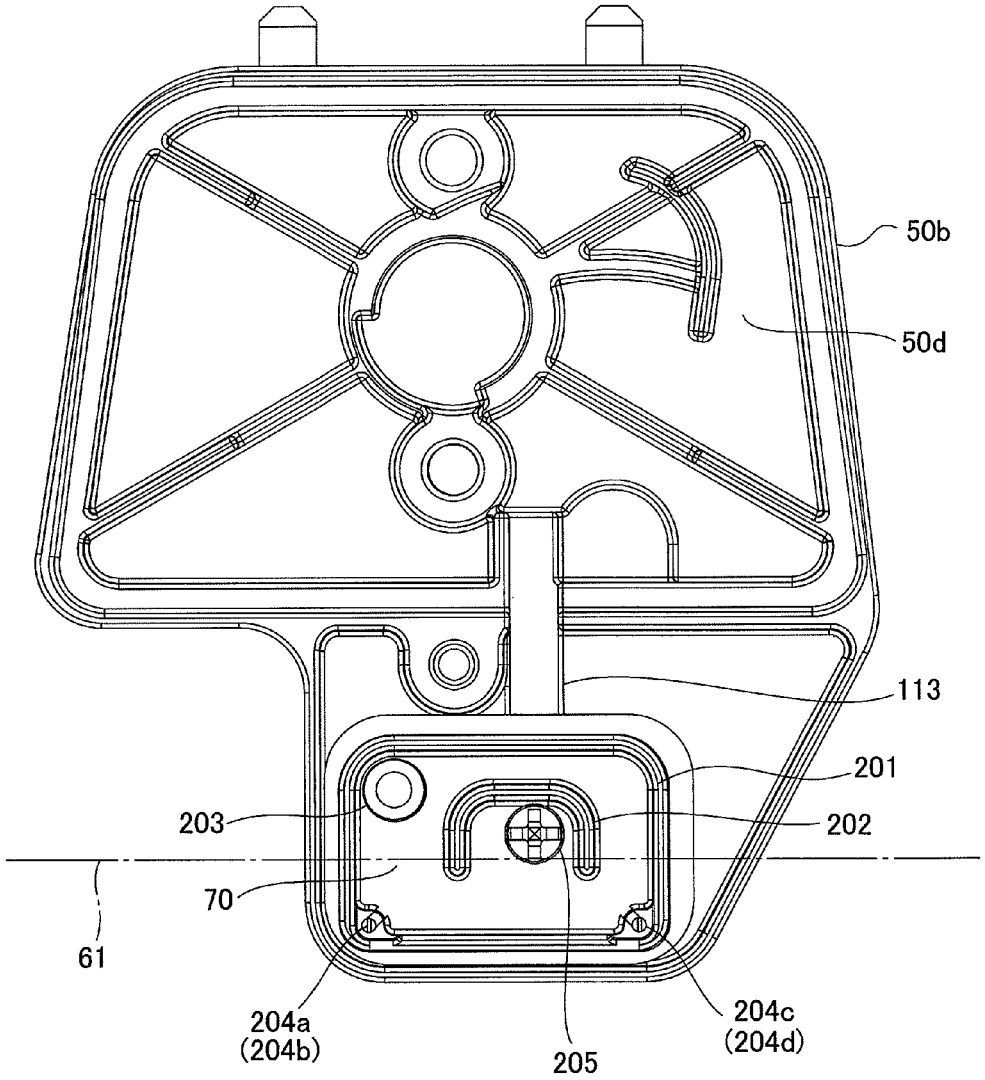
FIG. 8 is a drawing showing a state in which the gas-liquid separating plate is removed from FIG. 4.

FIG. 8 is a drawing showing a state in which the gas-liquid separating plate 401 is removed from FIG. 4.

As shown in FIG. 8, the inverted U-shaped wall 202 is formed to enclose the tapping screw 205. Here, the opening 403*a* of the blowby gas discharge part 400 is formed in the position approximately corresponding to the tapping screw 205.

Figure 9:
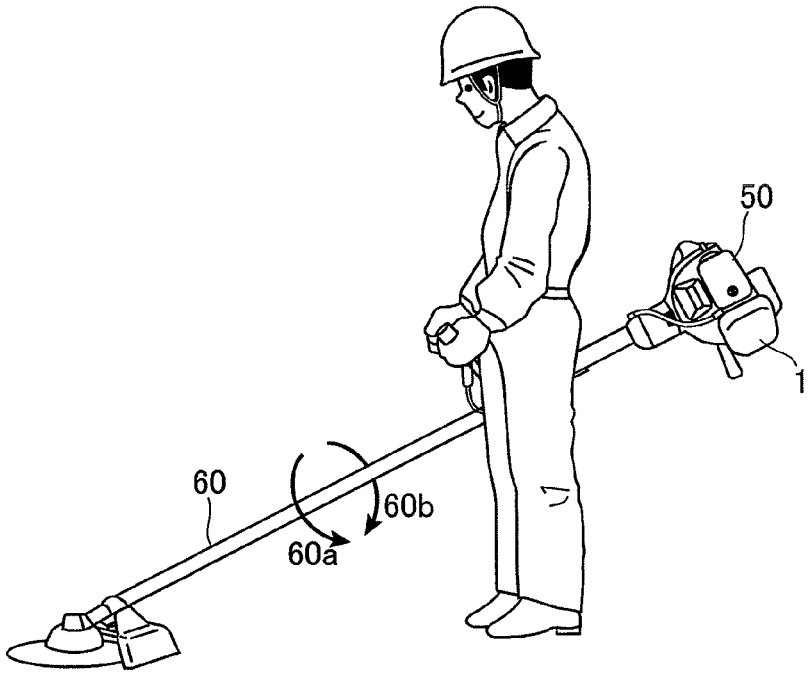
FIG. 9 is a drawing explaining the effect of an embodiment and showing oil discharge parts when a tool approaches the ground.
Figure 9:
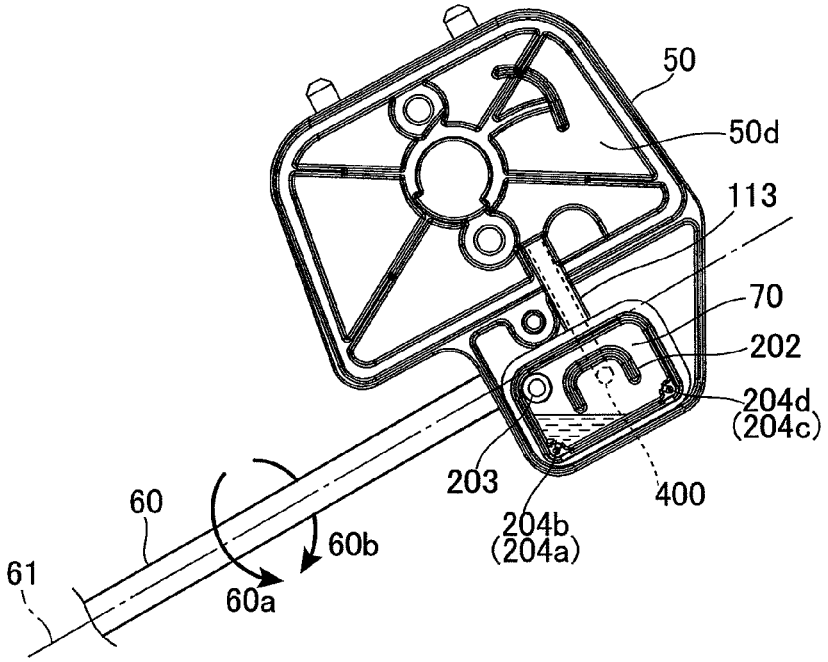

FIG. 9 is a drawing explaining the effect of the present embodiment and showing the oil discharge parts 204 when a tool approaches the ground.

FIG. 9A shows a case where a brush cutter as a tool is attached to the rod 60. Here, the tool is not limited to a blush cutter, but may be a coffee harvester, an olive harvester and so forth. For example, when the tool is a coffee harvester, it is assumed that the rod 60 is tilted forward as shown in FIG. 9A during work. In addition, the air cleaner 50 is mounted to the four-stroke engine 1 as shown in FIG. 9A. FIG. 9B is an enlarged view showing the air cleaner 50 and the rod 60 shown in FIG. 9A. Here, the main body of the four-stroke engine 1 is not shown in FIG. 9B. In addition, although there is essentially the tapping screw 205 in FIG. 9, it is omitted for ease of explanation. Moreover, the blowby gas discharge part 400 is shown in dashed line for purposes of illustration. The same applies to FIG. 10 and FIG. 11.

By the way, if the level of oil reaches the opening 403*a* of the blowby gas discharge part 400, a large amount of oil is supplied into the air cleaner space 50*d* through the blowby gas discharge part 400. This causes problems that a large amount of oil is consumed and oil cannot be completely combusted. Therefore, with the present embodiment, the openings 204*a* and 204*b* are formed in the tool direction as shown in FIG. 9B.

When the user works while the distance between the tool attached to the front end of the rod 60 and the ground is shorter than the distance between the four-stroke engine 1 and the ground, the air cleaner 50 is tilted as shown in FIG. 9A. In this case, the oil resulting from liquefying oil mist in is accumulated in the lower part of the gas-liquid separating chamber 70 in the rod direction. Then, the oil contacts the oil discharge parts 204*a* and 204*b*, and therefore is discharged from the oil discharge parts 204*a* and 204*b*. As a result, the level of oil is always low in the gas-liquid separating chamber 70. Accordingly, it is possible to significantly reduce the possibility of the problems that a large amount of oil is consumed and oil is not completely combusted.

The oil discharge part 204*a* is disposed in the gas-liquid separating chamber 70 in the air cleaner-to-rod axis direction. Therefore, it is possible to continue to discharge oil from the oil discharge part 204*a* even if the rod 60 rotates in the direction of arrow 60*b* in FIG. 9A. Meanwhile, the oil discharge part 204*b* is disposed in the gas-liquid separating chamber 70 in the anti-air cleaner-to-rod axis direction. Therefore, it is possible to continue to discharge oil from the oil discharge part 204*b* even if the rod 60 rotates in the direction of arrow 60*a* in FIG. 9A.

As described above, by providing the oil discharge parts 204*a* and 204*b*, it is possible to significantly reduce the possibility of the problems that a large amount of oil is consumed and oil is not completely combusted, even if the rod 60 is tilted forward or the rod 60 rotates.

Figure 10:
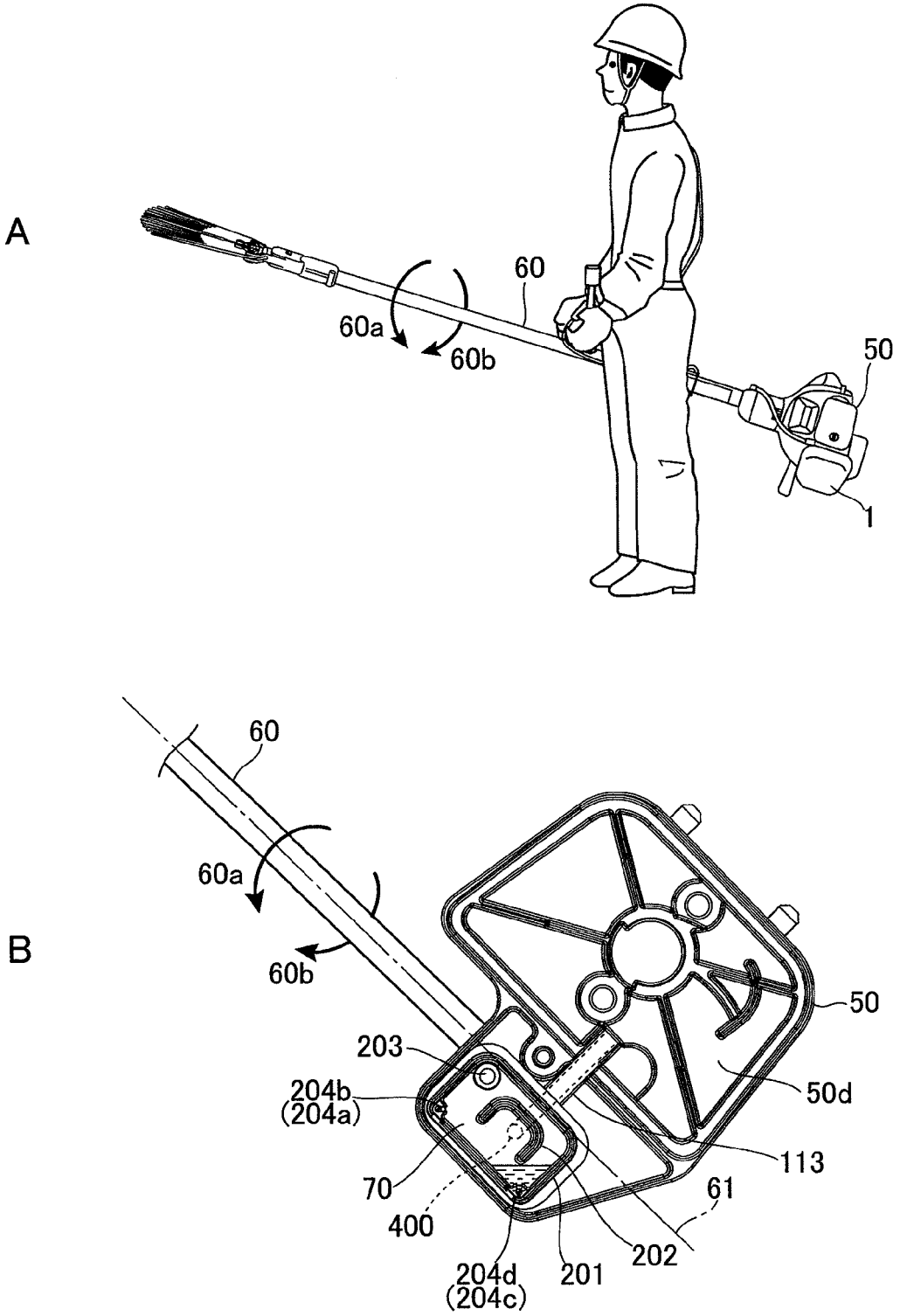
FIG. 10 is a drawing explaining a case in which a tool such as a coffer harvester is tilted backward in use.

FIG. 10 is a drawing explaining a case where a tool such as a coffee harvester is tilted backward in use.

Even if the tool is tilted backward in use, the oil discharge parts 204*c* and 204*d* are disposed in the anti-tool direction, and therefore it is possible to reliably discharge oil as the same way in FIG. 9.

Figure 11:
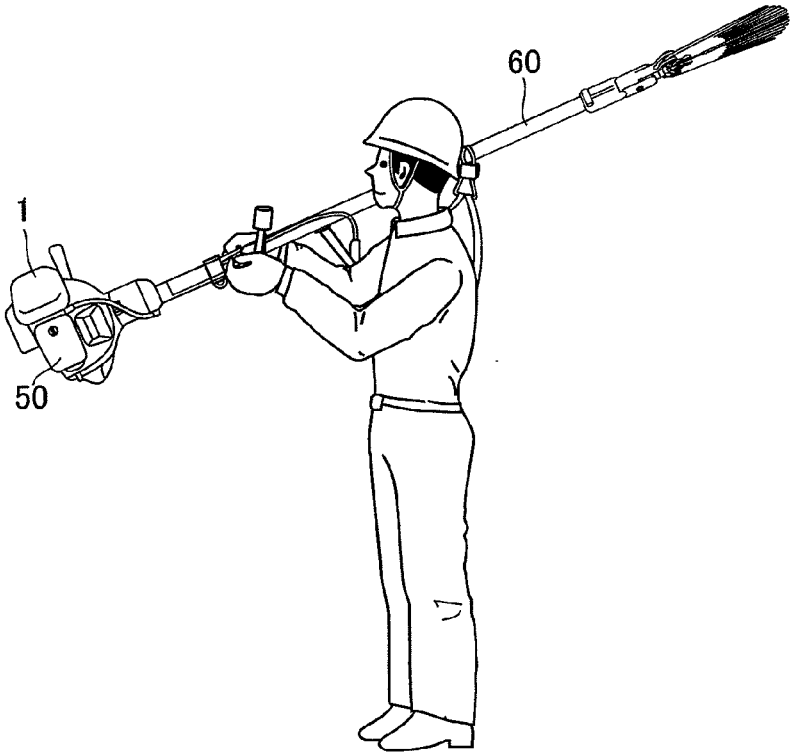
FIG. 11 is a drawing explaining a state in which the four-stroke engine is turned upside and down in use.
Figure 11:
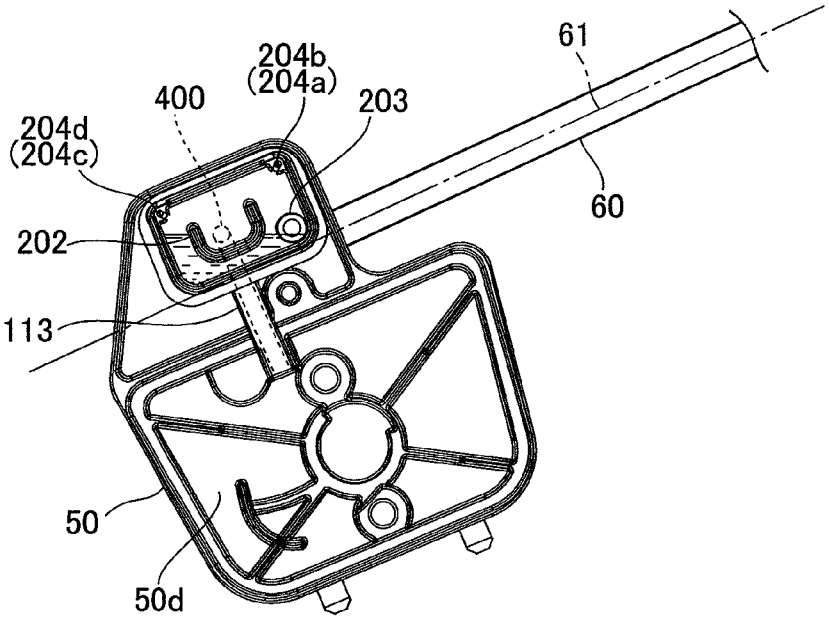

FIG. 11 is a drawing explaining a case in which the four-stroke engine 1 is turned upside and down in use. The four-stroke engine 1 may be turned upside and down as shown in FIG. 11A temporarily or for a certain period of time in use. In this case, if oil flows into the blowby gas discharge part 400, this causes problems that a large amount of oil is consumed and oil is not completely combusted. To address these problems, with the present embodiment, the inverted U-shaped wall 202 is provided. By providing this wall 202, it is possible to significantly lengthen the period of time until oil gets over the wall 202 and reaches the blowby gas discharge part 400 even if the oil is in the state shown in FIG. 11B.

<Configurations and Effects of Embodiment>

The four-stroke engine 1 for a working machine having the rod 60 to which a tool is attached, is provided. The tool is attached to one end of the rod 60 in the longitudinal direction, and the four-stroke engine 1 is fixed to the other end of the rod 60. The four-stroke engine 1 has the oil circulation pathway and the gas-liquid separating chamber 70 configured to separate oil from blowby gas. The gas-liquid separating chamber 70 includes: the inflow part 203 into which blowby gas is introduced from the oil circulation pathway; the oil discharge parts 204 configured to flow the oil separated from the blowby gas, back to the oil circulation pathway; the blowby gas discharge part 400 configured discharge the blowby gas not containing the oil, from the gas-liquid separating chamber 70 and supply the blowby gas to the intake passageway of the combustion chamber. The oil discharge parts 204 are provided on at least two corners of the lower part of the gas-liquid separating chamber 70 in the longitudinal direction. By this configuration, the gas-liquid separating chamber 70 can adequately separate liquid oil and oil mist from blowby gas, and therefore it is possible to reliably recover the separated oil. Consequently, it is possible to reduce the oil consumption. Moreover it is possible to reduce emission of unburned oil which causes environmental damage.

The plurality of oil discharge parts 204 are provided in the gas-liquid separating chamber 70 at intervals in the direction in which the oil discharge parts 204 are away from the axis line 61 of the rod 60. By this configuration, even if the gas-liquid separator 51 according to the present invention is located in the longitudinal direction and tilted in the direction orthogonal to the longitudinal direction (the right and left), it is possible to reliably recover the oil obtained by the gas-liquid separation.

The blowby gas discharge part 400 is open in the center of the gas-liquid separating chamber 70. By this configuration, even if the four-stroke engine 1 is tilted forward and backward or tilted to the right and left, it is possible to adequately separate liquefied oil and oil mist from the blowby gas and discharge the blowby gas to the combustion chamber side.

The blowby gas discharge part 400 is enclosed by the wall 202. With this configuration, the wall 202 functions as a baffle plate to prevent the inflow part 203 of the separator case 201 configured to communicate with the inflow port 101, from communicating with the first passageway 403 to discharge blowby gas, by the most direct way.

The inversed U-shaped wall 202 is open downward. By this configuration, even if the four-stroke engine 1 turns upside and down, the wall 202 functions as a baffle plate to prevent the liquefied oil from flowing into the opening 403*a* of the first passageway 403 to discharge blowby gas.

The gas-liquid separating chamber 70 branches from the oil circulation pathway and separates oil mist from blowby gas containing the oil mist. The gas-liquid separating chamber 70 includes: the inflow part 203 into which blowby gas is introduced from the oil circulation pathway; and the oil discharge parts 204 configured to flow the oil separated from the blowby gas back to the oil circulation pathway; and the blowby gas discharge part 400. The blowby gas discharge part 400 is open in the center of the gas-liquid separating chamber 70. The wall 202 is formed to enclose the blowby gas discharge part 400. By this configuration, fluid containing oil mist and blowby gas cannot reach the opening 403*a* unless the fluid flows past the wall 202 and turns back. In this say, the wall 202 functions as a baffle plate, and therefore it is possible to separate oil mist from the fluid.

The wall 202 has an inverted U-shape. By this configuration, even if the four-stroke engine 1 turns upside and down, the wall 202 functions as a baffle plate to prevent the liquefied oil from communicating with the opening 403*a* of the first passageway 403 to discharge blowby gas.

The gas-liquid separating member 301 is disposed between the inflow part 203 and the blowby gas discharging part 400. This configuration allows oil contained in blowby gas to collide with the gas-liquid separating plate 401, and therefore the gas-liquid separating member 301 can perform gas-liquid separation.

The gas-liquid separating member 301 has a mesh structure. Therefore, it is possible to allow oil mist with small droplets to adhere to the mesh and liquefy the oil mist, and therefore separate oil from blowby gas.

The invention claimed is:

1. A four-stroke engine for a working machine with a rod, a tool being attached to one end of the rod in a longitudinal direction and the four-stroke engine being fixed to the other end of the rod in use, the four-stroke engine comprising:

an oil circulation pathway;

a gas-liquid separating chamber configured to separate oil from blowby gas, the gas-liquid separating chamber including:

an inflow part into which the blowby gas is introduced from the oil circulation pathway;

oil discharge parts configured to flow the oil separated from the blowby gas back to the oil circulation pathway; and a blowby gas discharge part configured to discharge the blowby gas not containing oil from the gas-liquid separating chamber and supplies the blowby gas to an intake passageway to a combustion chamber, a wall part disposed to face an inflow direction of the inflow part, the blowby gas colliding against the wall part; and a gas-liquid separating member disposed between the inflow part and the blowby gas discharge part and having a mesh structure, wherein:

the gas having flowed from the inflow part passes through the gas-liquid separating member, collides against the wall part, passes through the gas-liquid separating member again, and then flows to the blowby gas discharge part; and the oil discharge parts are formed as openings on at least two corners in a lower part of the gas-liquid separating chamber in the longitudinal direction.

2. The four-stroke engine according to claim 1, wherein the plurality of oil discharge parts are formed in the gas-liquid separating chamber at intervals in a direction in which each of the oil discharge parts is away from an axis line of the rod.

3. The four-stroke engine according to claim 1, wherein the blowby gas discharge part is formed as an opening in a center of the gas-liquid separating chamber.

4. The four-stroke engine according to claim 2, wherein the blowby gas discharge part is formed as an opening in a center of the gas-liquid separating chamber.

5. The four-stroke engine according to claim 3, wherein the blowby gas discharge part is enclosed by an internal wall.

6. The four-stroke engine according to claim 4, wherein the blowby gas discharge part is enclosed by an internal wall.

7. The four-stroke engine according to claim 5, wherein the internal wall has an inverted U-shape which is open downward.

8. The four-stroke engine according to claim 6, wherein the internal wall has an inverted U-shape which is open downward.

9. The four-stroke engine according to claim 1, wherein a gas-liquid separating member is disposed between the inflow part and the blowby gas discharge part.

10. The four-stroke engine according to claim 1, a direction in which the blowby gas flows at the inflow part and a direction in which the blowby gas flows at the oil discharge parts are parallel to each other.

11. A four-stroke engine comprising:

a gas-liquid separating chamber configured to separate oil from blowby gas containing the oil, the gas-liquid separating chamber branching from an oil circulation pathway, the gas-liquid separating chamber including:

an inflow part into which the blowby gas is introduced from the oil circulation pathway;

oil discharge parts configured to flow oil separated from the blowby gas back to the oil circulation pathway; and a blowby gas discharge part configured to discharge the blowby gas not containing the oil, a wall part disposed to face an inflow direction of the inflow part, the blowby gas colliding against the wall part; and a gas-liquid separating member disposed between the inflow part and the blowby gas discharge part and having a mesh structure, wherein:

the gas having flowed from the inflow part passes through the gas-liquid separating member, collides against the wall part, passes through the gas-liquid separating member again, and then flows to the blowby gas discharge part;

the blowby gas discharge part is formed as an opening in a center of the gas-liquid separating chamber; and a wall is formed around the blowby gas discharge part.

12. The four-stroke engine according to claim 11, wherein the internal wall has an inverted U-shape which is open downward.

13. The four-stroke engine according to claim 11, wherein a gas-liquid separating member is disposed between the inflow part and the blowby gas discharge part.

14. The four-stroke engine according to claim 11, wherein the oil discharge parts are formed as openings within the separator case and on at least two corners in a lower part of the gas-liquid separating chamber in the longitudinal direction, and wherein the at least two corners are defined at intersections of the first side wall of the case with the bottom wall of the case and the second side wall of the case with the bottom wall of the case.

* * * * *